US008458992B2

(12) United States Patent
Zanini et al.

(10) Patent No.: US 8,458,992 B2
(45) Date of Patent: Jun. 11, 2013

(54) CAPPING MACHINE

(75) Inventors: Gianpietro Zanini, Montanara di Curtatone (IT); Marco Baroni, Barbasso di Roncoferraro (IT)

(73) Assignee: Azionaria Costruzioni Macchine Automatiche A.C.M.A. S.p.A. (IT)

( * ) Notice: Subject to any disclaimer, the term of this patent is extended or adjusted under 35 U.S.C. 154(b) by 470 days.

(21) Appl. No.: 12/671,156

(22) PCT Filed: Jul. 30, 2008

(86) PCT No.: PCT/IB2008/002100

§ 371 (c)(1),
(2), (4) Date: Jan. 28, 2010

(87) PCT Pub. No.: WO2009/016502

PCT Pub. Date: Feb. 5, 2009

(65) Prior Publication Data

US 2010/0205904 A1 Aug. 19, 2010

(30) Foreign Application Priority Data

Aug. 2, 2007 (IT) ..... BO07A0545

(51) Int. Cl.
*B67B 3/20* (2006.01)

(52) U.S. Cl.
USPC ..... 53/317; 53/331.5

(58) Field of Classification Search
USPC ..... 53/272, 276, 302, 308, 75, 76, 331.5, 53/287, 348, 292, 320, 347, 361, 317
IPC ..... B67B 3/20,3/22
See application file for complete search history.

(56) References Cited

U.S. PATENT DOCUMENTS

| | | | | | |
|---|---|---|---|---|---|
| 1,273,878 | A | * | 7/1918 | Lacroix | 53/302 |
| 1,651,903 | A | * | 12/1927 | Pennock | 53/302 |
| 1,734,529 | A | * | 11/1929 | Pennock | 53/317 |
| 3,964,240 | A | * | 6/1976 | Evrard | 53/306 |
| 4,089,153 | A | | 5/1978 | Long | |
| 4,232,499 | A | * | 11/1980 | Holstein | 53/331.5 |
| 4,299,072 | A | * | 11/1981 | Holstein | 53/306 |

(Continued)

FOREIGN PATENT DOCUMENTS

| | | | |
|---|---|---|---|
| EP | 677482 | A1 * | 10/1995 |
| EP | 0690020 | | 1/1996 |
| GB | 1245081 | | 9/1971 |
| JP | 05097183 | A * | 4/1993 |

OTHER PUBLICATIONS

Written Opinion and Search Report for PCT/IB2008/002100, mailed Dec. 15, 2008, 9 pages.

*Primary Examiner* — Stephen F Gerrity
(74) *Attorney, Agent, or Firm* — Timothy J. Klima; Shuttleworth & Ingersoll, PLC

(57) ABSTRACT

Containers are closed with screw caps by a carousel machine of which a central drum (31) is rotatable about a vertical axis (A) and carries a set of capping units (36) equipped with respective capping heads (37), each presenting a gripper (38) by which the cap (3) is held, and a mechanism (66) by which the hinged jaws (39) of the gripper (38) are opened and closed; each capping head (37) is capable of axial motion induced by components incorporated into the relative unit (36), which are guided axially in their movements and supported by auxiliary components (40; 49, 50) associated rigidly with the central drum (31).

14 Claims, 7 Drawing Sheets

U.S. PATENT DOCUMENTS 4,357,787 A * 11/1982 Long ..... 53/317
5,400,564 A * 3/1995 Humphries et al. ..... 53/75
5,467,527 A * 11/1995 Zanini et al. ..... 53/331.5
5,584,161 A * 12/1996 Zanini et al. ..... 53/317
6,482,094 B2 * 11/2002 Kefes ..... 464/182
7,322,170 B2 * 1/2008 Tomalesky et al. ..... 53/426
7,836,664 B2 * 11/2010 Zanini et al. ..... 53/317
2006/0260277 A1 * 11/2006 Brunee ..... 53/317

* cited by examiner

CAPPING MACHINE

CROSS-REFERENCE TO RELATED APPLICATIONS

This application is the National Phase of International Application PCT/IB2008/002100 filed Jul. 30, 2008 which designated the U.S. and that International Application was published under PCT Article 21(2) in English.

This application claims priority to Italian Patent Application No. BO2007A000545 filed Aug. 2, 2007, and PCT Application No. PCT/IB2008/002100 filed Jul. 30, 2008, which applications are incorporated by reference herein.

TECHNICAL FIELD

The present invention relates to a capping machine, and more exactly to a machine for closing containers with screw caps or with snap caps.

BACKGROUND ART

The prior art embraces capping machines consisting in a carousel rotatable about a vertical axis and comprising a drum that carries a plurality of capping units equispaced angularly about the periphery, each comprising a hollow shaft aligned on a vertical axis, of which a bottom portion incorporates a sliding bush and is fixed to a capping head equipped with a gripper mechanism.

The carousel also carries a disc located beneath and coaxial with the drum, affording seats on which to stand the containers.

Each seat receives a single container at an infeed station. At the same moment, the corresponding capping unit receives a cap.

As the carousel rotates, between the aforementioned infeed station and an outfeed station, the cap will be placed by the capping unit on the neck of the container and screwed tight.

The capping unit, and consequently the hollow shaft, is capable of axial motion, necessary in order to position the cap on the neck of the container, and rotary motion, necessary in order to screw the cap onto the container.

Conventionally, the rotary motion of the single capping unit is induced by a system of gears set in rotation by a central gear wheel aligned concentrically on the axis of the carousel.

The axial motion of the capping unit, on the other hand, is induced by a cam-following roller attached to the aforementioned bottom portion of the hollow shaft and engaging the track presented by a fixed cam of drum type, coaxial with the carousel.

The cap is held and twisted onto the container by a gripper of which the movements are induced mechanically, through the agency of means located inside the capping head and comprising calibrated springs such as will ensure a firm hold on the cap.

The gripper jaws are spread apart on completion of the screwing step by the action of cam means associated with the gripper and able to overcome the resistance offered by the springs.

Also associated with each capping head is a respective mechanical clutch that serves to shut off the transmission of rotary motion to the capping head, once the cap has been screwed tight and at the moment when the gripper jaws are spread.

Capping machines of the type in question present certain drawbacks.

Being invested with rotary and axial motion as described above, the hollow shafts that carry the capping heads will tend to labour under the forces of the gripper tension springs and of the cam-following rollers. In addition, the hollow shafts are subject to high levels of friction attributable to the use of sliding bushes.

Moreover, the single capping units are comparatively heavy and consequently become subject, during the rotation of the carousel, to appreciable centrifugal and inertia-related forces.

These various factors dictate the need to utilize high strength materials and to adopt precision machining procedures, in particular for the cams, also to follow extremely accurate and complex assembly procedures, in order to achieve and maintain a correct axial alignment of each capping unit with the axis of the relative container positioned beneath, and to ensure that this same axial alignment is checked periodically.

In addition, the system by which rotation is transmitted to each capping unit in prior art machines, utilizing an epicyclic train, is extremely complex and costly.

DISCLOSURE OF THE INVENTION

The object of the present invention is to provide a capping unit that will be unaffected by the drawbacks described above, as well as being economic, efficient and easily assembled.

BRIEF DESCRIPTION OF THE DRAWINGS

The invention will now be described in detail, by way of example, with the aid of the accompanying drawings, in which.

DETAILED DESCRIPTION OF THE PREFERRED EMBODIMENTS OF THE INVENTION

Figure 1:
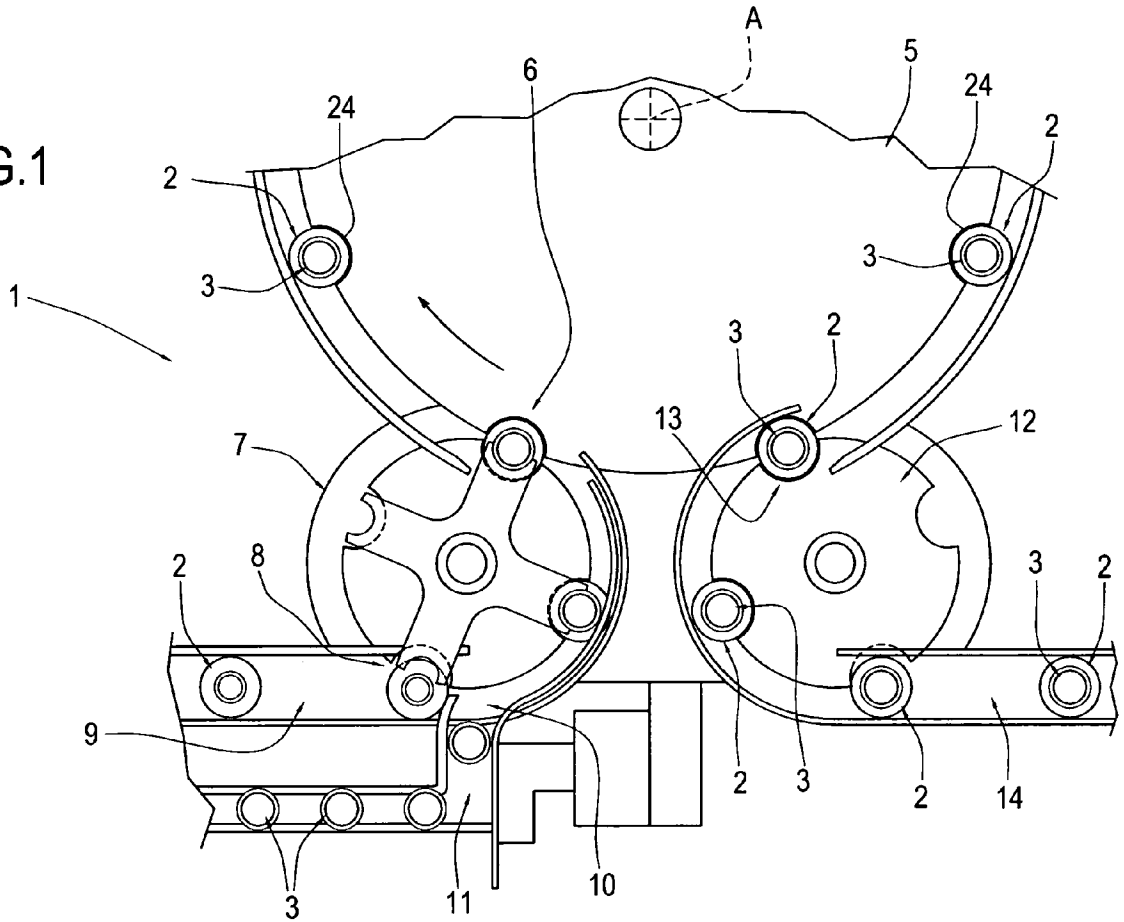
FIG. 1 is a schematic and fragmentary plan view of the capping machine according to the present invention.

With reference to FIG. 1, numeral 1 denotes a capping machine, in its entirety, utilized for closing containers 2 by means of respective caps 3.

Figure 2:
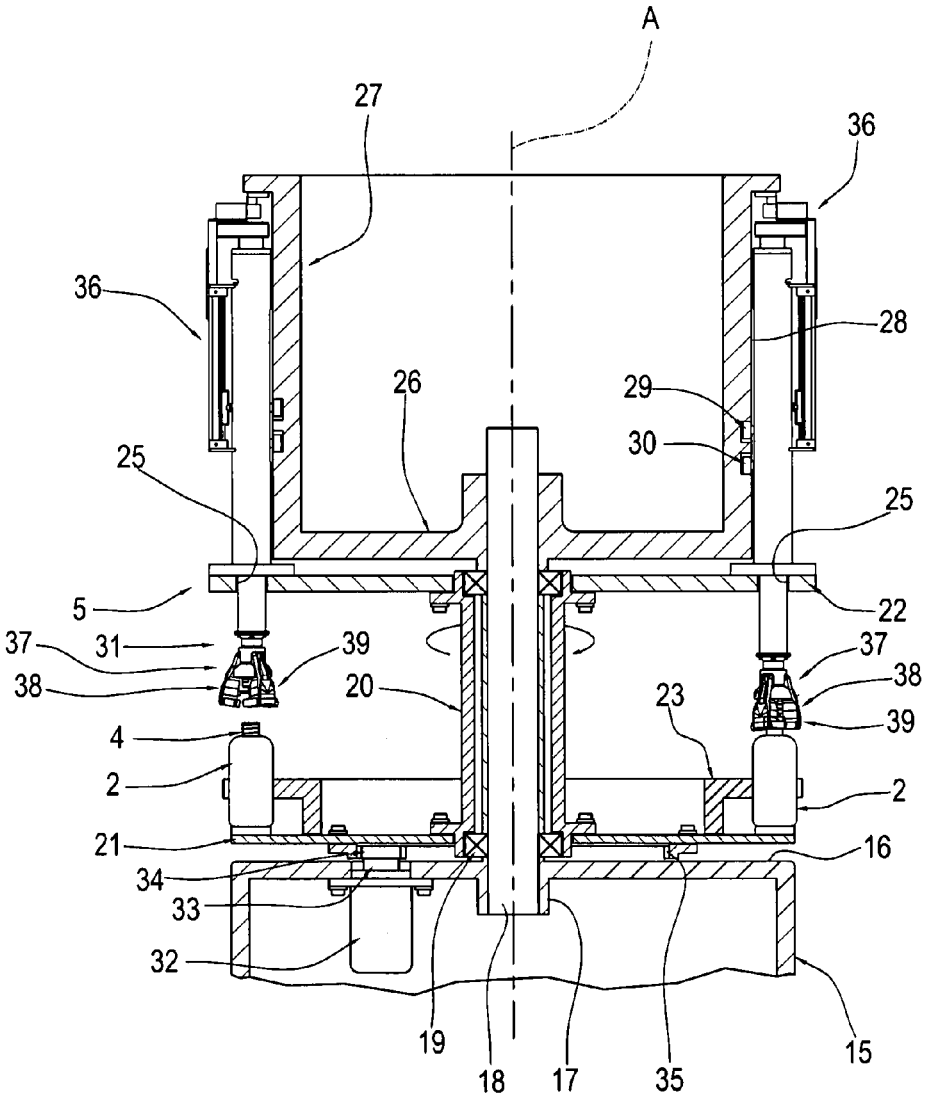
FIG. 2 is a detail of the machine in FIG. 1, illustrated schematically and in section, with certain parts omitted.
Figure 5:
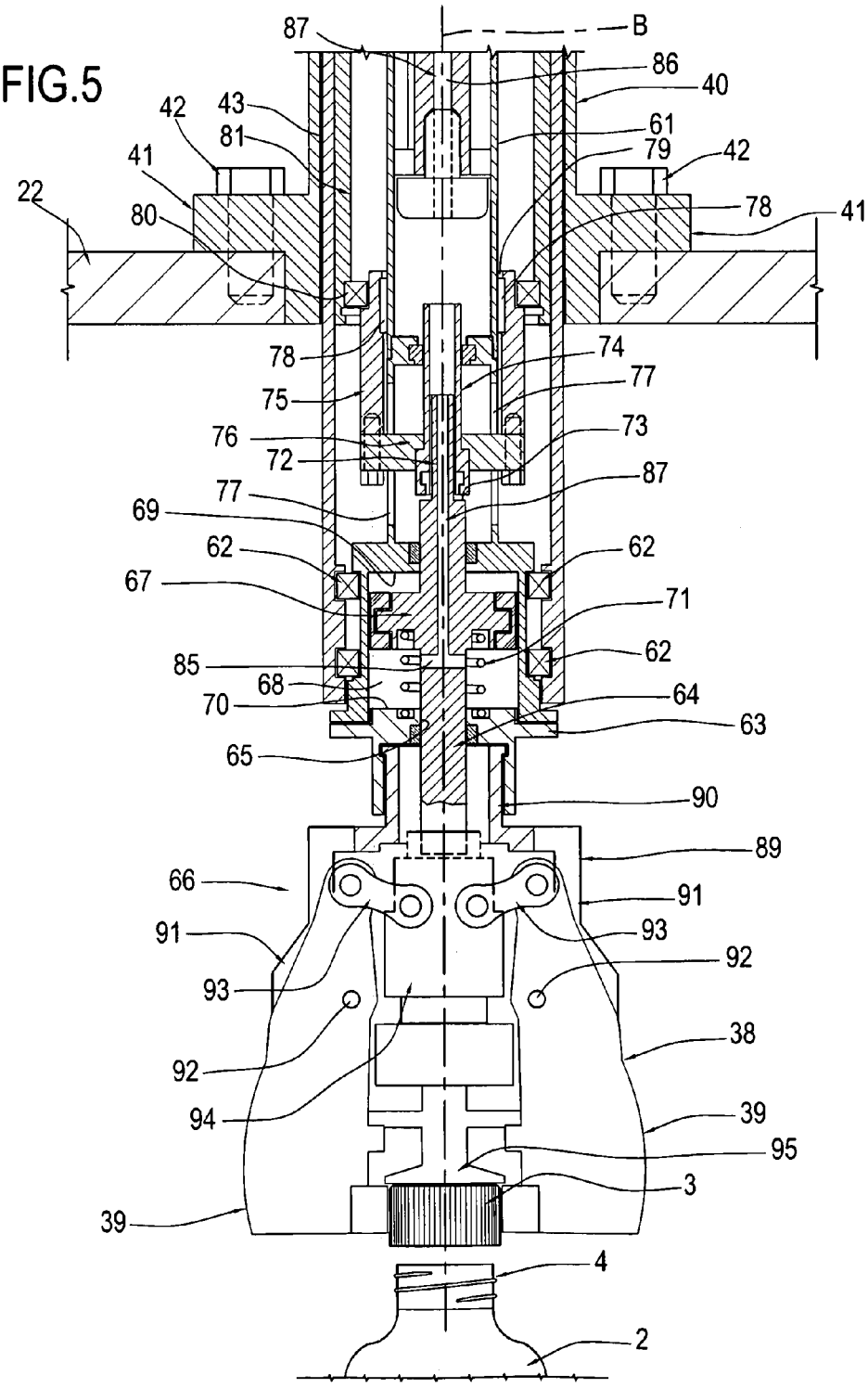

Referring also to FIGS. 2 and 5, each container 2 is fashioned with a neck 4 presenting an external thread, such as can be coupled with the internal thread of a relative cap 3.

The capping machine 1 comprises a carousel 5 mounted in such a way as to rotate about a vertical axis A, turning clockwise as seen in FIG. 1. The carousel 5 is supplied with a succession of containers 2 and with a separate succession of caps 3, both received at an infeed station 6 from a rotary conveyor 7.

The conveyor 7 is rotatable about an axis parallel to the aforementioned vertical axis A, turning anticlockwise as seen in FIG. 1, and placed to receive a succession of containers 2 at a first infeed station 8 from a horizontal channel 9.

The conveyor 7 also receives a succession of caps 3, at a second infeed station 10, from a horizontal channel 11 extending parallel to the channel 9 first mentioned.

The carousel 5 is designed to assemble the caps 3 with the relative containers 2 and thereupon to advance the containers 2, each fitted with its cap 3, toward a second rotary conveyor 12 operating at an outfeed station 13.

The second conveyor 12 is rotatable about an axis parallel to the aforementioned vertical axis A, turning anticlockwise as seen in FIG. 1, and serves to transfer the capped containers 2 from the outfeed station 13 to a horizontal transfer conveyor 14.

As illustrated in FIG. 2, the carousel 5 comprises a frame 15 with a substantially horizontal top wall 16 presenting a tubular boss 17 centred on the vertical axis A, which is occupied by a fixed shaft 18 passing through and extending upward from the wall 16. Mounted rotatably to this same shaft 18 by way of interposed bearings 19 is a tubular body, denoted 20, carrying a bottom circular flange 21 and a top circular flange 22.

The bottom flange 21 functions as a platform on which to stand the containers 2 and carries a disc 23, connected to its top surface and centred on the vertical axis A, affording a succession of peripheral seats 24 equispaced angularly one from the next (see also FIG. 1).

The top flange 22 is furnished peripherally with a plurality of circular holes 25, each aligned on a vertical axis B coinciding with a relative seat 24.

The fixed shaft 18 is disposed with its top end projecting above the top flange 22 and secured to a bottom wall 26 of a fixed cam drum 27 centred on the vertical axis A, of which the outer cylindrical wall 28 presents two annular grooves 29 and 30, upper and lower respectively.

The tubular body 20, the bottom flange 21 and the top flange 22 combine to create a central drum 31 mounted rotatably to the fixed shaft 18 and driven in rotation about the vertical axis A, turning clockwise as discernible in FIG. 2, by a motor 32 of which the output shaft 33 extends through the top wall 16 of the frame 15 and carries a keyed pinion 34 meshing with an internal ring gear 35 rotatable as one with the bottom flange 21 and centred on the vertical axis A.

As illustrated in FIGS. 2 to 6, each hole 25 accommodates a respective capping unit 36, furnished with a capping head 37 that comprises a gripper 38 with three angularly equispaced jaws 39, of which two only are visible in the accompanying drawings.

More exactly, each capping unit 36 is aligned on the respective axis B, supported by the top flange 22 at a point coinciding with the respective circular hole 25 and able thus to rotate as one with the drum 31 around the vertical axis A.

Figure 3:
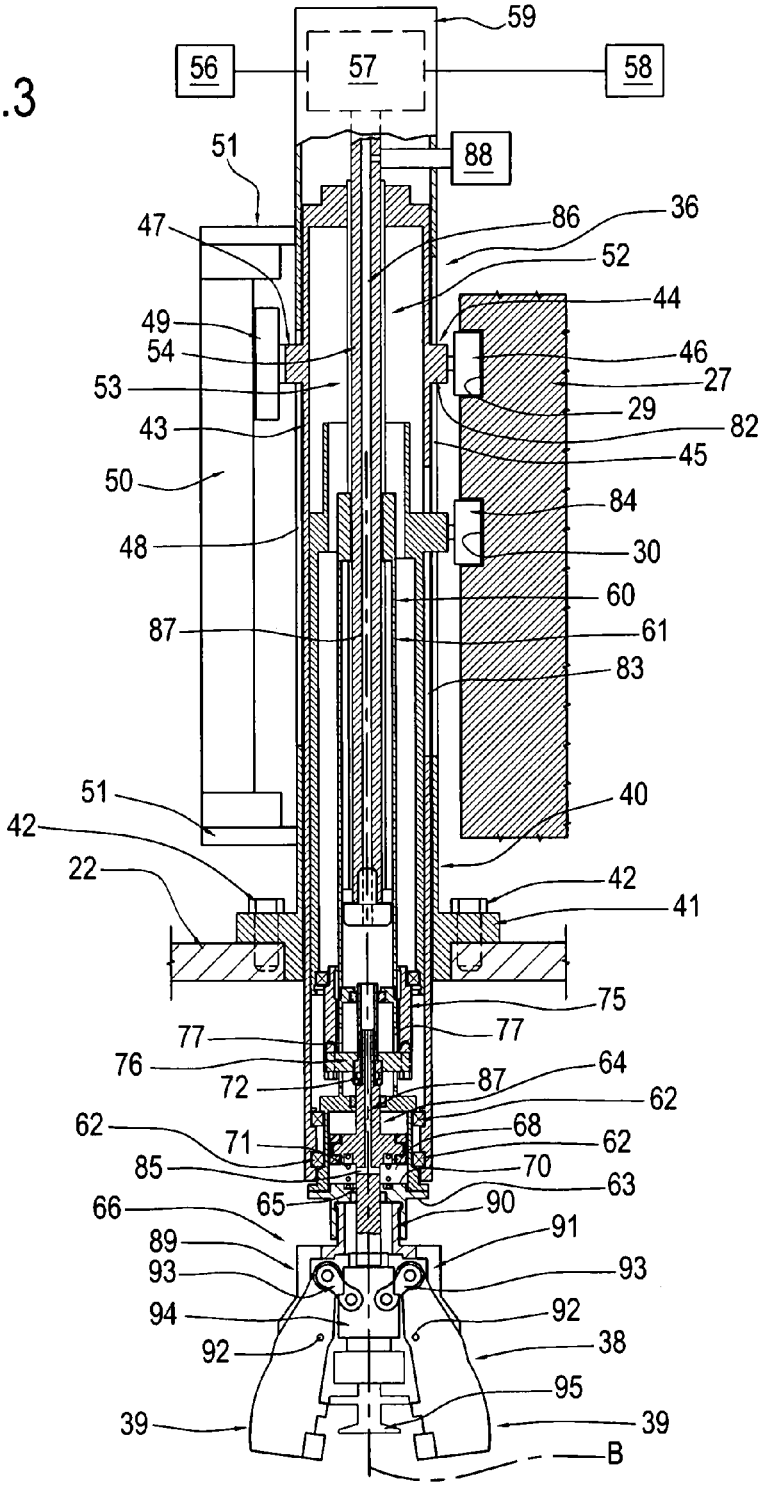
FIG. 3 is an enlarged detail of FIG. 2, illustrated in section.

Referring to FIG. 3, each capping unit 36 is equipped with axial guide means comprising an outer tubular element 40 aligned concentrically on the aforementioned axis B, presenting an annular projection 41 at an intermediate point along its length that rests on the top flange 22 and is fixed to the selfsame flange in the region of a corresponding hole 25, by way of screw means 42.

The tubular element 40 accommodates a coaxially aligned tubular body 43 slidable along the axis B of the capping unit.

The tubular body 43 is rigidly associated at its top end with an appendage 44 disposed transversely to the vertical axis B, slidably engaging an axial slot 45 afforded by the cylindrical wall of the tubular element 40.

Mounted to the free end of the appendage 44 is a cam-following roller 46, positioned to interact with the upper groove 29 of the cam drum 27 when the central drum 31 is set in rotation, in such a way as to displace the tubular body 43 axially in relation to the tubular element 40.

Also associated with the tubular body 43, diametrally opposite the appendage 44 first mentioned, is a second appendage 47 disposed transversely to the vertical axis B, slidably engaging a vertical slot 48 afforded by the cylindrical wall of the tubular element 40.

The free end of the second appendage 47 is rigidly associated with a slide 49 movable along the vertical axis of a pneumatic cylinder 50 fixed by way of brackets 51 to the cylindrical wall of the tubular element 40.

The slide 49 and the pneumatic cylinder 50 provide support means associated with the tubular body 43.

Figure 4:
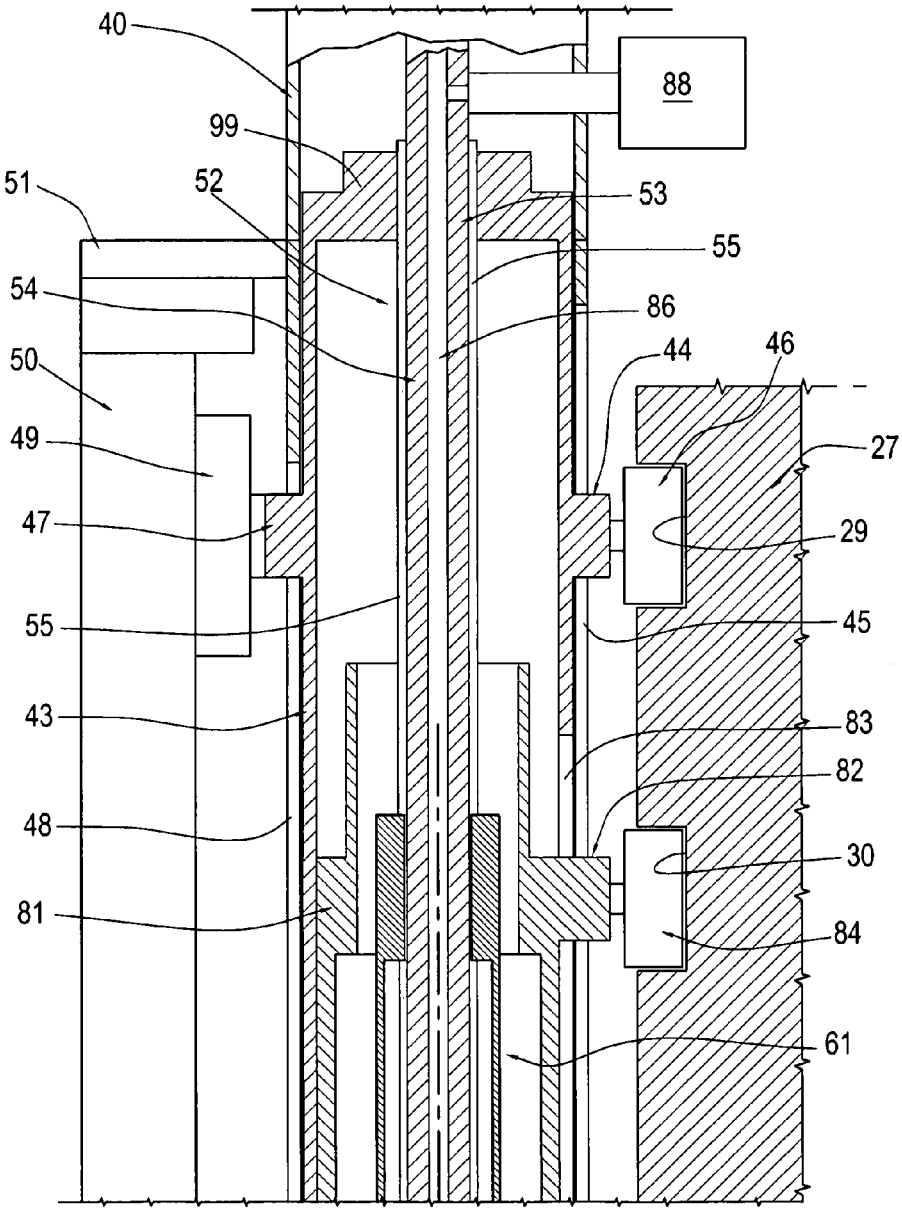
FIGS. 4, 5 and 6 show an enlarged detail of FIG. 3 in three different operating conditions.

With reference in particular to FIGS. 3 and 4, numeral 52 denotes a transmission, in its entirety, housed coaxially within the tubular body 43 and rotatable about the vertical axis B.

The transmission 52 comprises a first portion 53 uppermost, consisting in a rod 54 with longitudinal splines 55.

The top end of the splined rod 54, which extends beyond the top end of the tubular body 43, is connected to actuator means 56 by way of a clutch 57 interlocked to a master control unit 58, indicated schematically as a block in FIG. 3.

The clutch 57 is located internally of the tubular element 40, occupying a compartment 59 afforded by the top end of the selfsame element 40.

The transmission 52 further comprises a second portion 60 taking the form of an internally splined tubular shaft 61 driven in rotation by the splined rod 54, and free also to slide axially relative to the selfsame rod.

The bottom end of the tubular shaft 61 is connected axially by way of interposed bearings 62 to the bottom end of the tubular body 43, and enclosed by a substantially cylindrical body 63 that carries the aforementioned capping head 37, as will be described more fully in the course of the specification.

The transmission 52 also comprises a shaft 64, aligned coaxially with the tubular shaft 61, of which the bottom end passes through a hole 65 in the cylindrical body 63 and is connected to control linkage means, denoted 66 in their entirety, serving to open and close the jaws 39 of the gripper 38.

Figure 6:
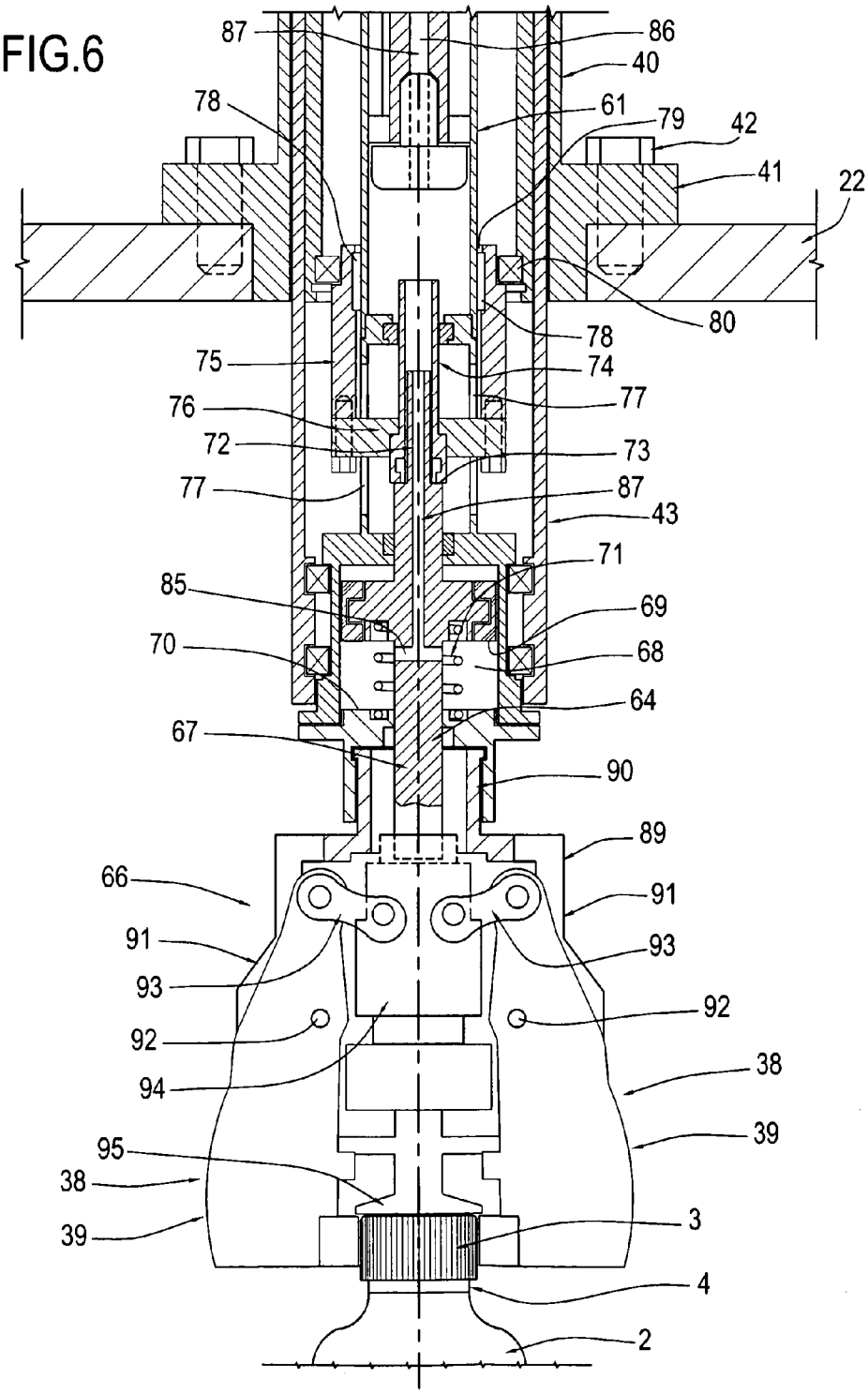

The aforementioned shaft 64 functions as the rod of a piston 67 slidable within a cylindrical chamber 68 afforded by the bottom end of the tubular shaft 61 and delimited by a top wall and a bottom wall, denoted 69 and 70 respectively in FIGS. 4, 5 and 6.

In addition, the space compassed between the bottom wall 70 of the chamber 68 and the piston 67 is occupied by a compression spring 71 coiled around the piston rod.

The top end of the shaft 64 presents a section 72 of smaller diameter, creating a shoulder 73 that functions as the end stop for a sleeve 74, aligned concentrically on the vertical axis B, into which the shaft 64 is slidably insertable.

The sleeve 74 is fixed to the bottom end of a coupling 75, aligned concentrically with and ensheathing the tubular shaft 61, by way of a cross bar 76 of which the two ends project externally of the tubular shaft 61 through respective slots 77.

The coupling 75 presents internal splines 78 interlocking longitudinally with matching external splines 79 presented by the tubular shaft 61.

Accordingly, the coupling 75 is driven in rotation by the tubular shaft 61 while able also to slide axially in relation to the selfsame shaft.

The coupling 75 is also connected axially, by way of an interposed bearing 80, to the bottom end of a second tubular body 81, aligned on the vertical axis B and interposed between the first tubular body 43 and the tubular shaft 61.

As illustrated in FIGS. 2 and 4, the top end of the second tubular body 81 presents an appendage 82 disposed transversely to the vertical axis B, passing through the slot 45 of the tubular element 40 and through a slot 83 afforded by the first tubular body 43.

The appendage 82 carries a following roller 84 running in the aforementioned lower groove 30 of the cam drum 27.

Thus, when the top flange 22 is set in rotation, the second tubular body 81, the coupling 75 and the piston 67 are caused by the cam drum 27 to shift along the vertical axis B.

The portion of the aforementioned cylindrical chamber 68 lying between the bottom wall 70 and the piston 67 incorporates a port, provided by a hole 85 passing transversely through the shaft 64, forming part of a pneumatic circuit 86 that comprises an axial duct 87 extending through the shaft 64, the sleeve 74 and the splined rod 54.

The circuit 86 in question is in receipt of compressed air from a source 88 schematized as a block in FIG. 3.

Referring to FIGS. 3, 4, 5 and 6, the capping head comprises a bell housing 89 with a top tubular appendage 90 secured to the inside of the aforementioned cylindrical body 63.

The housing 89 presents three radial slots 91, equispaced angularly one from the next and accommodating the jaws 39 of the gripper 38. The gripper 38 of each head is supported by horizontal pivots 92 passing through the respective jaws 39 at an intermediate height.

The top end of each jaw 39 is connected by means of respective link rods 93 to a block 94 rigidly associated with the bottom end of the shaft 64 and slidable axially within a cylindrical recess afforded by the housing 89.

The block 94 and the link rods 93 provide the aforementioned linkage means 66 by which the jaws 39 of the gripper 38 are opened and closed.

The bottom end of the block 94 carries a restraint 95 aligned on the vertical axis B, which is offered to the cap during the twisting step of the capping sequence.

The operation of the capping machine 1 will now be described, referring first to FIG. 1, beginning from a situation in which a container 2 and a relative cap 3 are directed by the rotary conveyor 7 onto the carousel 5 at the infeed station 6, positioned one above the other, at a moment timed to coincide with the passage of a capping unit 36.

The container 2 passes from the infeed station 6 onto the platform afforded by the bottom flange 21, occupying a relative seat 24 presented by the disc 23.

The profile presented by the upper groove 29 of the cam drum 27 is configured in such a way that when the container 2 and the relative cap 3 are admitted to the carousel 5, the capping head 37 will descend gradually from an upper travel limit position to a point at which the restraint 95 makes contact with the cap 3.

More exactly, the descending motion in question is induced by the cam drum 27, through the agency of the cam-following roller 46, in the tubular body 43, the tubular shaft 61, the cylindrical body 63 and the housing 89.

The profile presented by the lower groove 30 of the cam drum 27, in its turn, causes the three jaws 39 of the gripper 38 to be drawn together gradually by the control linkage means 66, simultaneously with the aforementioned descending movement.

More exactly, the second tubular body 81 is constrained by the cam-following roller 84 to slide axially in relation to the first tubular body 43, inducing motion in the cross bar 76 and the sleeve 74 by way of the coupling 75.

The upward sliding motion of the sleeve 74 allows the piston rod shaft 64 to shift upwards under the force of the spring 71, thereby pulling the block 94 upwards and causing the jaws 39 to close through the action of the link rods 93.

During the course of this step, in which the cap 3 is gripped, the actuator means 56 are kept disengaged from the splined rod 54 through the action of the clutch 57, piloted by the control unit 58, and the rod 54 consequently does not rotate.

As the carousel 5 turns, the capping head 37 is lowered gradually by the interaction between the upper groove 29 of the cam drum 27 and the following roller 46, to the point at which the cap 3 engages the neck 4 of the container 2.

At this point, the control unit 58 will pilot the clutch 57 to connect the splined rod 54 and the actuator means 56, with the result that the jaws 39 of the gripper 38 are set in rotation about the vertical axis B.

More exactly, rotation is transmitted by the splined rod 54, and the tubular shaft 61, both to the coupling 75 with the cross bar 76 and to the capping head 37.

During the step of twisting the cap 3 onto the neck, the source of compressed air 88 is connected by the control unit 58 to the part of the chamber 68 between the bottom wall 70 and the piston 67, by way of the pneumatic circuit 86, in such a way as to induce a further upward movement of the shaft 64 through the action of the piston 67, thereby increasing the clamping force at the jaws 39 of the gripper 38 and ensuring that the jaws stay locked in the gripping position.

In the event that the caps 3 are not screwed, but snapped onto the container, the clutch 57 will keep the actuator means 56 permanently disengaged from the splined rod 54, which therefore does not rotate at any stage.

Figure 7:
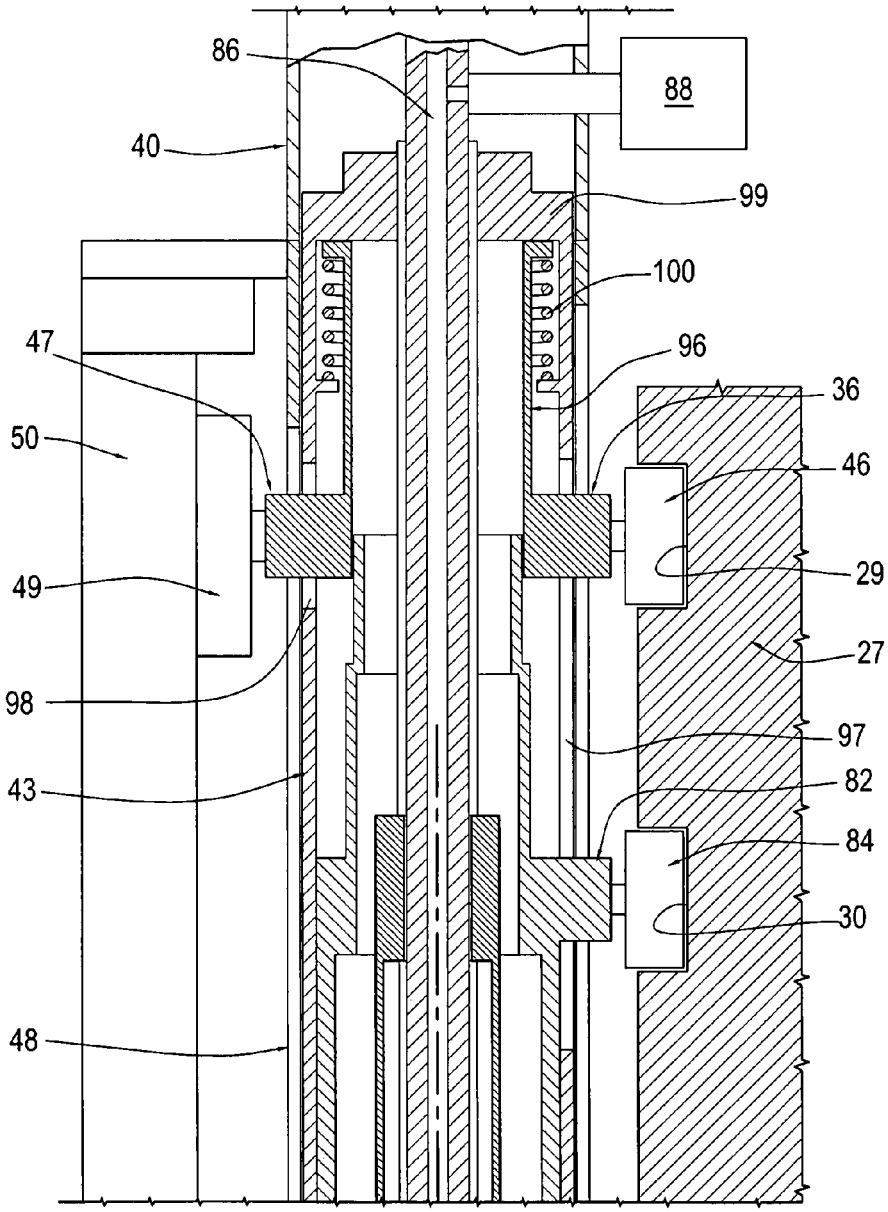
FIG. 7 is a detail of the machine in FIG. 1, illustrated schematically and in section, in a second possible embodiment.

In a further embodiment of the invention, illustrated in FIG. 7, the top end of the means by which axial motion is induced could incorporate a coupling 96, located internally of and slidable relative to the first tubular body 43.

The aforementioned appendages 44 and 47 are fixed to this same coupling 96 and insertable through respective vertical slots 97 and 98 in the tubular body 43.

The coupling 96, enclosed uppermost by an annular cover 99, is ensheathed by a coil compression spring 100, interposed between the annular cover 99 and the topmost end of the tubular body 43 beneath.

In operation, the coupling 96 is caused by the action of the cam-following roller 46 to shift downwards from an upper travel limit position, along the vertical axis B.

As the appendage 47 locates against the bottom edge of the relative slot 98, the coupling 96 begins to drive the tubular body 43 downwards, and with it the capping head 37.

Once the cap 3 held between the jaws 39 of the gripper 38 has engaged the neck 4 of the container 2, and during the subsequent step in which the cap 3 is twisted onto the neck, the tubular body 43 remains free to return upwards, moving against the action of the spring 100, which thus serves as a damper cushioning the movement of the capping head 37 during operation.

It will be seen from the foregoing description that a capping unit in accordance with the present invention affords significant advantages over capping units identifiable with the prior art.

The design of the tubular elements 40, forming an integral part of the carousel structure 5, is such that the positioning of the single capping units 36 can be rendered simple and secure, eliminating any risk of misalignment with the relative vertical axis B even when the carousel 5 is in rotation.

In addition, the capping head 37 has no internal gears and the clutch mechanism is located above the single capping unit, thereby achieving a reduction in weight and consequently minimizing centrifugal and inertia-related forces.

In the embodiment described thus far, the actuator means 56 by which the capping head 37 is rotated about the vertical axis B consist in an asynchronous electric motor, and the clutch 57 is a magnetic powder type.

In the event that a particularly accurate orientation of the cap is required, relative to the container, for example a cap of non-circular or special geometry, the actuator means 56 might take the form of a brushless motor connected to the single capping units by way of a timing belt drive and interlocked to the master control unit 58, which will monitor and govern the torque, speed and position parameters of the drive.

What is claimed is:

1. A capping machine for closing containers with respective caps, comprising a carousel rotatable about a first vertical axis and having:

a central drum;

at least one capping unit carried in rotation by the central drum about the vertical axis and comprising a capping head with a gripper having jaws for holding a cap, and a control linkage mechanism for opening and closing the gripper, the capping unit comprising a driving mechanism for axially moving the capping head along a second axis, and a guiding mechanism for axially guiding and supporting the driving mechanism;

the driving mechanism comprising a first tubular body aligned concentrically on the second axis and set in motion by a first cam mechanism;

the guiding mechanism being rigidly associated with the central drum and comprising an outer tubular element coaxial with the first tubular body and carried by the central drum;

wherein the guiding mechanism further comprises a pneumatic cylinder aligned on an axis parallel to the second axis, and a slide movable along the cylinder, insertable through a slot in a cylindrical wall of the tubular element and fixed to the first tubular body.

2. A machine as in claim 1, wherein the driving mechanism further comprises a second tubular body coaxial with the first tubular body and movable along the second axis by a second cam mechanism to operate the control linkage mechanism for opening and closing the gripper.

3. A machine as in claim 2, wherein the first and the second cam mechanisms comprise a fixed cam drum aligned concentrically on the first axis and having a first annular groove and a second annular groove.

4. A machine as in claim 3, wherein the capping unit comprises a transmission housed internally of the first tubular body and the second tubular body, by which rotary motion is transferred from an actuator to the capping head to rotate the capping head about the second axis.

5. A machine as in claim 4, wherein the transmission comprises a first portion having a rod with axial splines, a second portion having a tubular shaft slidable axially along the splined rod and engaging axially with the first tubular body, and a third portion having a coupling driven in rotation by the tubular shaft, engaging axially with the second tubular body and operating the control linkage mechanism.

6. A machine as in claim 5, wherein the third portion of the transmission further comprises a sleeve rigidly associated with the coupling, a shaft slidably engaging an interior of the coupling along a segment of predetermined length delimited by a shoulder, operating the control linkage mechanism, and a spring mechanism for maintaining the shaft and the coupling in contact one with another at the shoulder.

7. A machine as in claim 6, further comprising a pneumatic circuit connected to a source of compressed air and communicating with a chamber of a bottom end of the tubular shaft, at a point between a bottom wall of the chamber and a piston, such that the shaft can be held forcibly in a raised position by the piston, when piloted by a control unit, to lock the gripper securely when closed.

8. A machine as in claim 1, wherein the jaws of the gripper are attached to a block having a rigidly associated restraint against which the cap is steadied during its application to a neck of the container.

9. A machine as in claim 1, wherein the driving mechanism comprises a top coupling movable by the first cam mechanism, the top coupling mounted slidably in relation to the first tubular body, loaded against an interposed spring mechanism and displaceable thus between two limit positions determined by two ends of a slot of the first tubular body.

10. A capping machine for closing containers with respective caps, comprising a carousel rotatable about a first vertical axis and having:

a central drum;

at least one capping unit carried in rotation by the central drum about the vertical axis and comprising a capping head with a gripper having jaws for holding a cap, and a control linkage mechanism for opening and closing the gripper, the capping unit comprising a driving mechanism for axially moving the capping head along a second axis, and a guiding mechanism for axially guiding and supporting the driving mechanism;

the guiding mechanism being rigidly associated with the central drum;

wherein the driving mechanism comprises a first tubular body aligned concentrically on the second axis and set in motion by a first cam mechanism wherein the driving mechanism further comprises a second tubular body coaxial with the first tubular body and movable along the second axis by a second cam mechanism to operate the control linkage mechanism for opening and closing the gripper;

wherein the capping unit comprises a transmission housed internally of the first tubular body and the second tubular body, by which rotary motion is transferred from an actuator to the capping head to rotate the capping head about the second axis;

wherein the transmission comprises a first portion having a rod with axial splines, a second portion having a tubular shaft slidable axially along the splined rod and engaging axially with the first tubular body, and a third portion having a coupling driven in rotation by the tubular shaft, engaging axially with the second tubular body and operating the control linkage mechanism.

11. A machine as in claim 10, wherein the third portion of the transmission further comprises a sleeve rigidly associated with the coupling, a shaft slidably engaging an interior of the coupling along a segment of predetermined length delimited by a shoulder, operating the control linkage mechanism, and a spring mechanism for maintaining the shaft and the coupling in contact one with another at the shoulder.

12. A machine as in claim 11, further comprising a pneumatic circuit connected to a source of compressed air and communicating with a chamber of a bottom end of the tubular shaft, at a point between a bottom wall of the chamber and a piston, such that the shaft can be held forcibly in a raised position by the piston, when piloted by a control unit, to lock the gripper securely when closed.

13. A capping machine for closing containers with respective caps, comprising a carousel rotatable about a first vertical axis and having:

a central drum;

at least one capping unit carried in rotation by the central drum about the vertical axis and comprising a capping head with a gripper having jaws for holding a cap, and a control linkage mechanism for opening and closing the gripper, the capping unit comprising a driving mechanism for axially moving the capping head along a second axis, and a guiding mechanism for axially guiding and supporting the driving mechanism;

the driving mechanism comprising a first tubular body aligned concentrically on the second axis and set in motion by a first cam mechanism;

the guiding mechanism being rigidly associated with the central drum and comprising an outer tubular element coaxial with the first tubular body and carried by the central drum;

wherein the driving mechanism further comprises a second tubular body coaxial with the first tubular body and movable along the second axis by a second cam mechanism to operate the control linkage mechanism for opening and closing the gripper;

wherein the capping unit comprises a transmission housed internally of the first tubular body and the second tubular body, by which rotary motion is transferred from an actuator to the capping head to rotate the capping head about the second axis.

14. A capping machine for closing containers with respective caps, comprising a carousel rotatable about a first vertical axis and having:

a central drum;

at least one capping unit carried in rotation by the central drum about the vertical axis and comprising a capping head with a gripper having jaws for holding a cap, and a control linkage mechanism for opening and closing the gripper, the capping unit comprising a driving mechanism for axially moving the capping head along a second axis, and a guiding mechanism for axially guiding and supporting the driving mechanism;

the driving mechanism comprising a first tubular body aligned concentrically on the second axis and set in motion by a first cam mechanism;

the guiding mechanism being rigidly associated with the central drum and comprising an outer tubular element coaxial with the first tubular body and carried by the central drum;

wherein the driving mechanism comprises a top coupling movable by the first cam mechanism, the top coupling mounted slidably in relation to the first tubular body, loaded against an interposed spring mechanism and displaceable thus between two limit positions determined by two ends of a slot of the first tubular body.

* * * * *